US005902642A

United States Patent [19]

Horiki et al.

[11] Patent Number: 5,902,642

[45] Date of Patent: May 11, 1999

[54] MASKING MEMBER MADE OF ENGINEERING PLASTIC

[75] Inventors: Seinosuke Horiki; Reiji Makino, both of Nagoya; Norihiko Kioka, Tokoname, all of Japan

[73] Assignee: Nayoya Oilchemcial Co., LTD., Aichi, Japan

[21] Appl. No.: 08/854,836

[22] Filed: May 12, 1997

Related U.S. Application Data

[63] Continuation of application No. 08/446,676, filed as application No. PCT/JP93/01398, Sep. 29, 1993, abandoned.

[51] Int. Cl.[6] ..... B05D 1/32; B05C 13/00

[52] U.S. Cl. ..... 427/282; 118/504; 118/505

[58] Field of Search ..... 427/282; 118/504, 118/505

[56] References Cited

U.S. PATENT DOCUMENTS

| | | | |
|---|---|---|---|
| 4,671,850 | 6/1987 | Shimkunas | 156/643 |
| 4,676,193 | 6/1987 | Martin | 118/505 |
| 4,759,959 | 7/1988 | Guy | 427/282 |
| 5,063,872 | 11/1991 | Maus et al. | 118/505 |
| 5,224,240 | 7/1993 | Smith et al. | 118/505 |
| 5,397,598 | 3/1995 | DiPaolo et al. | 427/282 |

FOREIGN PATENT DOCUMENTS

| | | | |
|---|---|---|---|
| 307932 | 3/1989 | European Pat. Off. . | |
| 0350031 | 1/1990 | European Pat. Off. | 118/505 |
| 367260 | 5/1990 | European Pat. Off. . | |
| 0483377 | 5/1992 | European Pat. Off. | 118/505 |

*Primary Examiner*—Katherine A. Bareford

*Attorney, Agent, or Firm*—Donald S. Dowden; Cooper & Dunham LLP

[57] ABSTRACT

An object of the present invention is to repeatedly use a masking member which is applied in a surface treatment having a heating process at a high temperature. To attain said object, said masking member of the present invention uses an engineering plastic having a high mechanical strength and a high heat resistance as a material.

18 Claims, 23 Drawing Sheets

MASKING MEMBER MADE OF ENGINEERING PLASTIC

This is a continuation of application Ser. No. 08/446,676, filed May 26, 1997, now abandoned, which is a national stage application of PCT/JP93/01398, filed Sep. 29, 1993.

FIELD OF THE INVENTION

The present invention relates to a masking member which is used to protect a part of an article from a surface treatment such as coating, plating and the like.

DESCRIPTION OF THE PRIOR ART

In case a part to be protected is a plane or a hole, a masking member having an adhesive layer is attached to the part through the adhesive layer. In case the part is a hole, a masking member having an inserting part is attached to the hole part by inserting said inserting part into the hole. In case the part is a panel, a masking member having a ditch is attached to the part by fitting the ditch to the panel. In case the part is a protrusion, a masking member having a fitting part is attached to the part by fitting the fitting part to the protrusion. And after the surface treatment, such masking members are removed from the parts respectively.

Hitherto, material consisting of thermoplastic resin mixed with inorganic filler has been provided for such masking members (TOKKAIHEI 2-126966).

Among the thermoplastic resin materials polyolefin especially has strong solvent resistance and is mechanically reinforced by mixing with inorganic filler, so that a thermal conductivity of which will increase and a thermal resistance of which will also increase; therefore, said masking members can be used repeatedly.

However, with respect to the above mentioned conventional masking members, thermal resistance of which is 150° C. at the highest even mixed with inorganic filler, and in a process of surface treatment which requires a temperature higher than 150° C., the masking members are deformed.

DISCLOSURE OF THE INVENTION

As a means to solve the above described problem in the prior art, the present invention provides a masking member which is made of an engineering plastic.

BRIEF DESCRIPTION OF THE DRAWINGS

FIG. 1 is the perspective view of the first embodiment.

FIG. 2 is the partial sectional view of the first embodiment when the masking member is attached.

FIG. 3 is the partial sectional view of the first embodiment when the masking member is removed.

FIG. 4 is the perspective view of the second embodiment.

FIG. 5 is the partial sectional view of the second embodiment when the masking member is attached.

FIG. 6 is the partial perspective view of the second embodiment when the masking members are produced.

FIG. 8 is the perspective view of the fourth embodiment.

FIG. 9 is the partial sectional view of the fourth embodiment when the masking member is attached.

FIG. 10 is another partial sectional view of the fourth embodiment when the masking member is attached.

FIG. 11 is the perspective view of the fifth embodiment.

FIG. 12 is the partial sectional view of the fifth embodiment when the masking member is attached.

FIG. 13 is the perspective view of the sixth embodiment.

FIG. 14 is the partial sectional view of the sixth embodiment when the masking member is attached.

FIG. 17 is the perspective view of the ninth embodiment.

FIG. 18 is the partial sectional view of the ninth embodiment when the masking member is attached.

FIG. 19 is the perspective view of the tenth embodiment.

FIG. 20 is the partial sectional view of the tenth embodiment when the masking member is attached.

FIG. 21 is the perspective view of a car-body of the practical example.

FIG. 22 is the explanatory perspective view of Part A of the practical example.

FIG. 23 is the explanatory perspective view of Part B of the practical example.

FIG. 24 is the explanatory perspective view of Part C of the practical example.

FIG. 25 is the explanatory perspective view of Part D of the practical example.

FIG. 26 is the explanatory perspective view of Part E of the practical example.

FIG. 27 is the perspective view of the eleventh embodiment.

FIG. 28 is the sectional view of the eleventh embodiment when the masking member is attached.

FIG. 29 is the perspective view of the twelfth embodiment before the masking member is attached.

FIG. 30 is the sectional view taken along line A—A of FIG. 29.

FIG. 31 is the sectional view taken along line A—A of FIG. 29 when the masking member is attached.

FIG. 32 is the perspective view of the thirteenth embodiment.

FIG. 33 is the partial sectional view of the thirteenth embodiment when the masking member is attached.

FIG. 34 is the perspective view of the fourteenth embodiment.

FIG. 35 is the partial sectional view of an inlet of fuel tank of the fourteenth embodiment.

FIG. 36 is the expalanatory sectional view of the fourteenth embodiment when adhesive layer is applied.

FIG. 37 is the perspective view of the fifteenth embodiment.

FIG. 38 is the sectional view of the fifteenth embodiment when the masking member is attached.

FIG. 39 is the front view of a group of masking members of the fifteenth embodiment.

FIG. 40 is the front view of a masking member separated from the group of masking members of the fifteenth embodiment.

FIG. 41 is the perspective view of the sixteenth embodiment.

FIG. 42 is the sectional view of the sixteenth embodiment when the masking member is attached.

FIG. 43 is the perspective view of the seventeenth embodiment.

FIG. 44 is the sectional view of the seventeenth embodiment when the masking member is provisionally fixed.

FIG. 45 is the sectional view of the seventeenth embodiment when the masking member is attached.

FIG. 46 is the front view of the seventeemth embodiment when the masking member is attached.

In the drawings,

(1) . . . article

(11) . . . car-body

Figure 1:
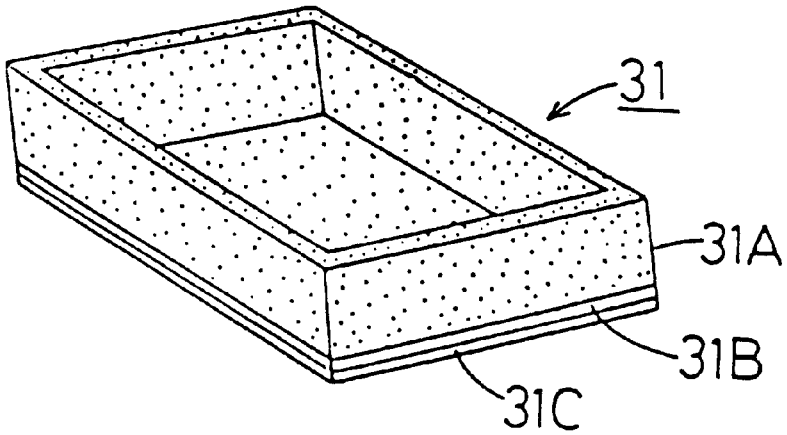
FIG. 1 to FIG. 3 relate to the first embodiment of the present invention.

(12) . . . underside of car body

(13) . . . bumper

(14) . . . inlet of fuel tank

(15) . . . pillar

(2) . . . part being protected

(21) . . . protrusion

(22) . . . hole

(23) . . . extending part

(31)~(317) . . . masking member

(31A)~(316A) . . .body

(4) . . . coating layer

DETAIL DESCRIPTION OF THE INVENTION

An engineering plastic used in the present invention is such as: thermoplastic-type engineering plastic such as methylpentene copolymer (TPX), polyethylene terephthalate (PET), polyamide (PA), polycarbonate (PC), cellulose acetate (CA), polysulphone (PSF), polyethersulphone (PES), polyphenylene sulphide (PPS), polyphenylene ether (PPE), polyamideimide (PAI), polyetherimide (PEI), polyether-etherketone (PEEK), polyimide (PI), polyester (PE), polyamide such as nylon 6 and nylon 66, polybutylene terephthalate (PBT), polyallylester (PAE), polyethylene naphthalate (PEN), polyallylate (PAR), polyvinylidene fluoride ($PVF_2$) and the like; liquid crystal-type engineering plastic such as polyallylether and the like; compression molding-type engineering plastic such as fluororesin and the like; amorphous polymer; aminobimaleimide; bimaleimidoazine thermosetting aromatic polyimide; and the like. The above described engineering plastic may be foamed plastic and two or more kinds of said engineering plastics may be mixed or laminated together.

A filler or a reinforcing material such as calcium carbonate, magnesium carbonate, barium sulphate, calcium sulfite, magnesium hydroxide, aluminum hydroxide, magnesium oxide, titan white, iron oxide, zinc oxide, alumina, silica diatom earth, dolomite, gypsum, talc, clay, asbestos, mica, calcium silicate, bentonite, white carbon, carbon black, iron powder, aluminum powder, stone powder, blast furnace slag, flyash, synthetic fiber, natural fiber, glass fiber, carbon fiber, ceramic fiber, whisker and the like may be mixed in the engineering plastic. 10 to 200% by weight of said filler is commonly mixed with said engineering plastic.

Further, one or more kind of: thermoplastic resin such as polyolefin such as polyethylene, polypropylene, ethylene-propylene copolymer, ethylene-vinylacetate copolymer and the like, polyvinyl chloride, polystyrene, polymethacrylate, polyvinylidene chloride, stylene-butadiene copolymer, polyamide and the like; plastic foam of the above described thermoplastic resin; polyurethane foam; and the like, may be mixed or laminated with the engineering plastic. A desirable engineering plastic is a polymer alloy such as PPE and polyamide, high-impact plystylene, polystylene and the like.

A surface treatment such as corona discharge treatment, primer coating treatment and the like is preferably effected on the surface of the engineering plastic to increase its affinity with paint or adhesive. Also releasing treatment may be effected on the surface of said engineering plastic to decrease its affinity with paint or adhesive. A primer used in the primer coating treatment is, for example: synthetic rubber such as modified polyolefin or olefin copolymer such as chlorinated polypropylene or ethylene-vinylacetate copolymer, stylene-butadiene rubber, acrylonitrile-butadiene rubber, chloroprene rubber, polybutadien and the like; synthetic resin such as acrylic synthetic resin, vinyl synthetic resin, acrylic synthetic resin including amino group and/or amide, vinyl synthetic resin including amino group and/or amide, amino synthetic resin, epoxy synthetic resin and the like; and low-molecular weight primer such as aluminium alcholate or aluminium chelate agent such as aluminium isopropylate, aluminium triacetylacetonate and the like; alkyl metal such as 2-ethylhexyl lead, hexadecyl lithium and the like; organotin compound such as dibutyl tin diacetate, di-n-butyl tin dioxide and the like; silane compound such as methylvinyl dichloro silane and the like; metal complex salt of 1,3-dicarbonyl compound such as acetylacetone lithium, acetylacetone beryllium and the like; organotitan compound such as tetrabutyl titanate and the like; boric acid compound such as tri-n-butyl borate, triphenyl borate and the like; phosphate such as trioleil phosphate, tridecyl phosphate and the like; metal salt of a carboxylic acid such as magnesium stearate, cobalt naphtenic acid and the like; metal thioalcholate such as n-potassium dodecylmercapto chloride and the like; thiodicarboxylate such as 2-ethylhexane dithio acid zinc and the like; metal salt of a dithiocarbamic acid such as nickel dimethyldithiocarbamate, copper dimethyldithiocarbamate and the like; metal salt of sulfonic acid such as nickel benzenesulfonate and the like; organophosphate compound such as dibutylvanadium phosphate and the like. One or more kinds of said primers may be mixed together.

Said primer has affinity with both said engineering plastic and synthetic resin other than said engineering plastic which is generally used as a paint vehicle or an adhesive for said engineering plastic. A preferable primer is an acrylic synthetic resin containing quarternary ammonium salt or a synthetic resin containing amino group. For the primer coating treatment, a solution or an emulsion of one or more kinds of said primer is coated on the surface of said engineering plastic as the material for the masking member and then dried.

Prior to said primer coating treatment, an affinity treatment may be effected on the surface of said engineering plastic. The examples of said affinity treatment are flame treatment, sulfuric acid treatment, corona discharge treatment and the like, and the surface of said engineering plastic is slightly carbonyzed by said treatment to obtain the affinity with other synthetic resin.

Further, the examples of a release agent used for the surface treatment of said engineering plastic are a silicone type release agent, a fluoro type release agent, a fatty acid type release agent, a paraffine type release agent, a wax type release agent and the like.

For releasing treatment, a solution or a emulsion of one or more kinds of said releasing agent or melted releasing agent is coated on the surface of said engineering plastic and then dried or cooled.

Said engineering plastic may be colored by a pigment or a dyestuff to discriminate the masking parts, and also, a flame-retardant, an insecticide, an antiseptic, an antioxidant, an ultraviolet absorber, a blowing agent such as a chemical blowing agent, a capsule type blowing agent and the like, and the like may be mixed with said engineering plastic. Two or more kinds of said agents may be mixed and then added to said engineering plastic.

To manufacture the masking member by using said engineering plastic as a material, commonly the vacuum-forming method in which a film or a sheet of said engineering plasticis vacuum-formed is most appropriate because it is the most suitable method for mass-production, however, press molding method, blow molding method, injection molding method and the like may be applied to manufacture the masking member. Both unstretched film or sheet and stretched film or sheet of said engineering plastic may be used to manufacture the masking member.

Said engineering plastic has a high heat resistance and the masking member made of said engineering plastic has a high mechanical strength and said masking member does not soften or deformed even at a temperature higher than 150° C.

Accordingly, in the present invention, the masking member can be used repeatedly even in the surface treatment having a heating process at a high temperature.

[Masking member Type A]

Masking member Type A is used to protect the even surface of an article.

Figure 2:
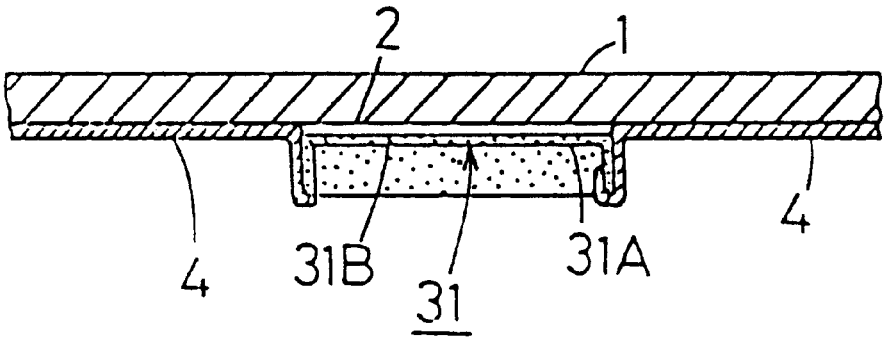
Figure 3:
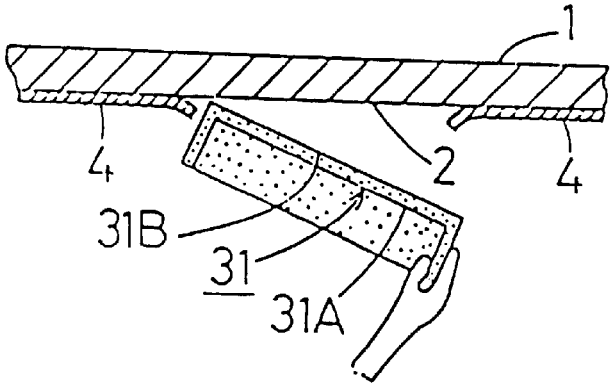

FIG. 1 to FIG. 3 relate to the first embodiment of the present invention. Referring now to FIG. 1 to FIG. 3, a masking member (31) comprises a body (31A) having a vessel form consisting of a rectangular bottom and an adhesive layer (31B) formed on the under surface of said body (31A), with said body (31A) manufactured by vacuum forming of a sheet consisting of polyphenylenesulfide in which 50% by weight of calcium carbonate is mixed. Said adhesive layer (31B) is covered with a release sheet (31C) such as a polyethylene film, a polypropylene film, a release paper and the like to prevent sticking to another article, the hands of workers and the like when the masking members are handled, stacked, transported, kept and the like.

When said masking member (31) is used, said release sheet (31C) is removed from said adhesive layer (31B) and said masking member (31) is then attached to an even part (2) of the surface of an article (1) by said adhesive layer (31B) thereof, which is necessary to be protected from a surface treatment. After said masking member (31) is attached to said part (2), for example, a coating material is coated on the surface of said article (1) by spraying as shown in FIG. 2. Said part (2) of said surface of said article (1) is not subjected to said coating since said part (2) is covered with said masking member (31). Said part (2) may have hole(s) and in this case, said hole(s) is (are) also not subjected to said coating.

After or before said coated article (1) is heated to dry and/or cure if desired, and said masking member (31) may be removed by a worker's hand as shown in FIG. 3.

Said masking member (31) consisting of the above-mentioned sheet is easily manufactured by vacuum forming and can be reused without deformation.

Further in a case when a silicone treatment is effected on the surface of said masking member (31), affinity of the surface of said masking member (31) with the paint reduces and the film of the paint is easily peeled from the surface of said masking member (31) so that said masking member (31) can be repeatedly used after peeling the film of the paint.

Figure 4:
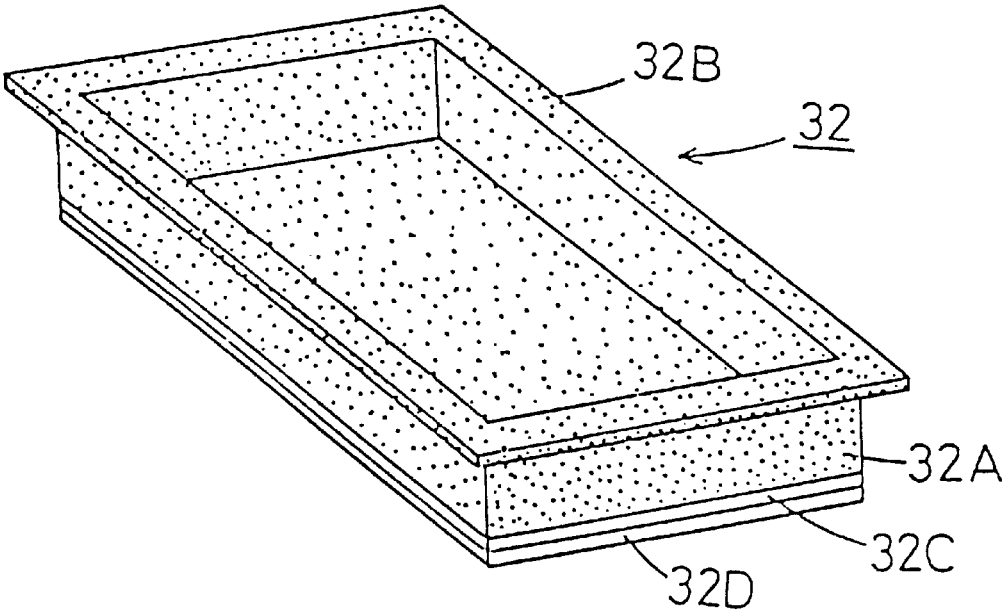
FIG. 4 to FIG. 6 relate to the second embodiment of the present invention.
Figure 5:
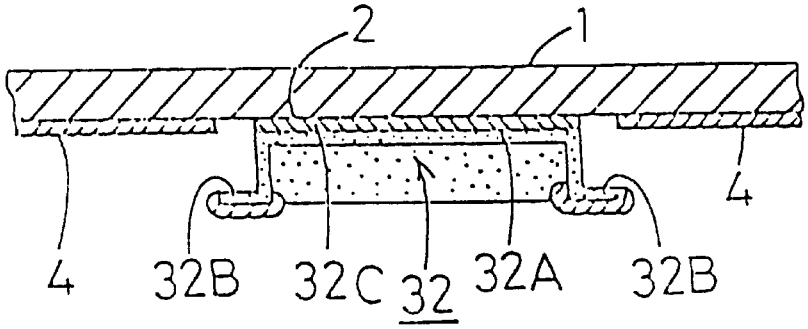
Figure 6:
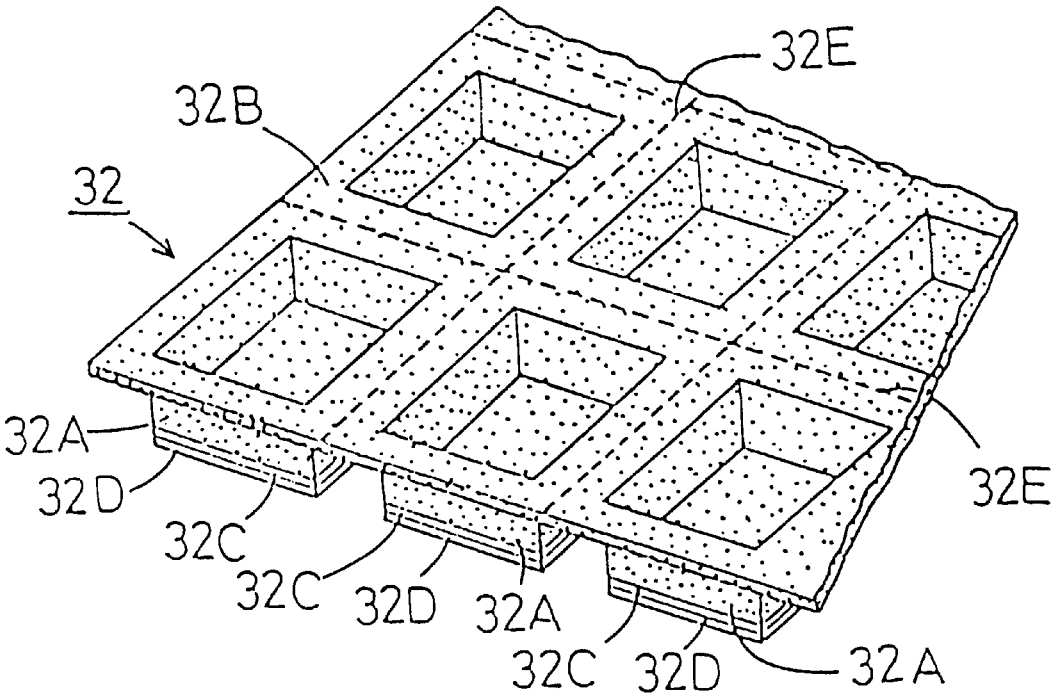

FIG. 4 to FIG. 6 relate to the second embodiment of the present invention. Referring now to FIG. 4 to FIG. 6, a masking member (32) comprises a body (32A) having a vessel form consisting of a rectangular bottom and perpendicular walls which extend upwards from the perimeter of said bottom, and a flange (32B) which is extended from the upper edges of said walls and an adhesive layer (32C) formed on the under surface of said body (32A), with said body (32A) manufactured by vacuum forming of a sheet consisting of polyethylene telephthalate in which 30% by weight of talc is mixed. An adhesive layer (32C) is formed on the under surface of said body (32A) and said adhesive layer (32C) is covered with a release sheet (32D). Said masking member (32) is attached to an even part (2) of the surface of an article (1) the same as the first embodiment of the present invention.

In this embodiment, said coating layer (4) is cut by said flange (32B) of said masking member (32) as shown in FIG. 5. As the results, said masking member (32) may be smoothly removed from said part (2) of said surface of said article (1) by a worker's hand without obstruction of said coating layer (4). Said masking member (32) is easily manufactured by vacuum forming and can be reused the same as the first embodiment.

A number of masking members (32) of this embodiment may advantageously be produced by vacuum forming, if desired. Referring to FIG. 6, a number of bodies (32A) of masking member (32) are formed arranged in rows and lines, and each body (32A) is connected to the other body (32A) by the flange (32B). Cutting lines (32E) or grooves are formed between said flange (32B) and another said flange (32B) and when said masking member (32) is used, said masking member (32) is broken along said cutting lines (32E) or grooves by hand. Said cutting lines (32E) or groovess may be formed simultaneously with vacuum forming or after vacuum forming.

Figure 7:
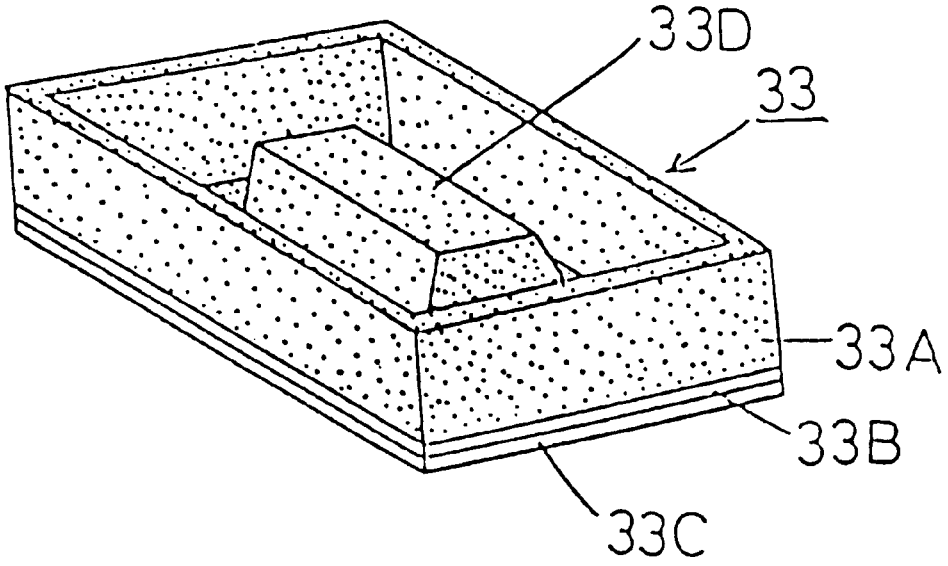
FIG. 7 is the perspective view of the third embodiment of the present invention.

FIG. 7 relates to the third embodiment of the present invention. In this embodiment, a masking member (33) comprised a body (33A) having a vessel form consisting of a rectangular bottom from which a grip (33D) is risen and perpendicular walls which extend upwards from the perimeter of said bottom and an adhesive layer (33B) formed on the under surface of said body (33A), with said body (33A) manufactured by vacuum forming of a sheet consisting of polyamide in which 40% by weight of calcium carbonate is mixed. Said adhesive layer (33B) is covered with a release sheet (33C) the same as the first embodiment. The masking member (33) of this embodiment is easily handled by holding said grip (33D) of said masking member (33) and is easily manufactured by vacuum forming and can be reused the same as the first embodiment.

[Masking member Type B]

Masking member Type B is used to protect an even surface or a protruding part of an article. Said masking member B is manufactured by vacuum forming of two layers sheets consisting of polyetherester imide in which 30% by weight of glass fiber is mixed and polypropylene sheet in which 15% by weight of calcium carbonate and 5% by weight of stylene-butadiene elastomer is mixed.

Figure 8:
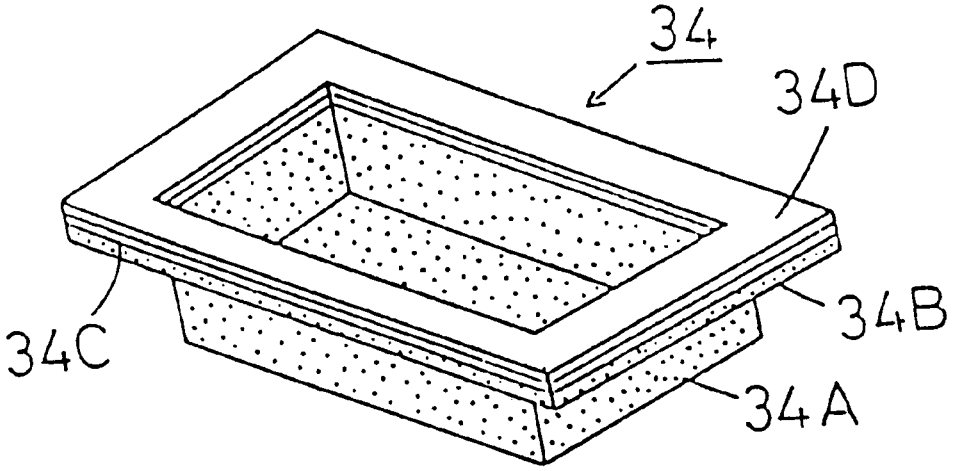
FIG. 8 to FIG. 10 relate to the fourth embodiment of the present invention.
Figure 9:
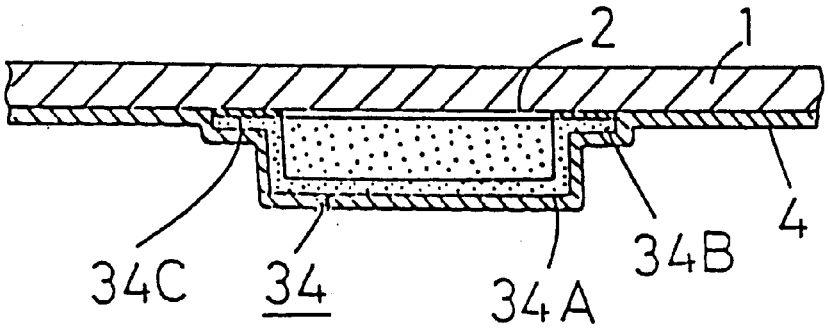

FIG. 8 and FIG. 9 relate to a fourth embodiment of the present invention. Referring now to FIG. 8 and FIG. 9, a masking member (34) comprises a body (34A) having a vessel form consisting of a rectangular bottom, perpendicular walls which extend upwards from the perimeter of said bottom, a flange (34B) which is extended from the upper edges of said walls, and an adhesive layer (34C) formed on the surface of said flange (34B). Said adhesive layer (34C) is covered with a release sheet (34D).

Figure 10:
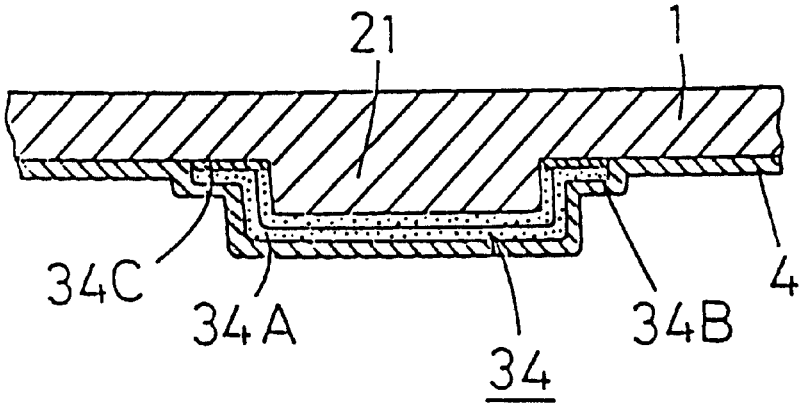

Referring to FIG. 9, when said masking member (34) is used, said release sheet (34D) is removed from said adhesive layer (34C) and said masking member (34) is then attached to an even part (2) of the surface of an article (1) by said adhesive layer (34C) thereof. After said masking memeber (34) is attached to said part (2) of said surface of said article (1) is not subjected to said coating since said part (2) is covered with said masking member (34). After forming a coating layer (4), said masking member is removed by a worker's hand. Further, said even part (2) may have hole(s). And further, as shown in FIG. 10, said masking member (34) is also used to protect a protruding part (21) of said article (1) by covering said protruding part (21) with said masking member (34). Said masking member (34) is easily manufactured by vacuum forming and can be reused without deformation.

Figure 11:
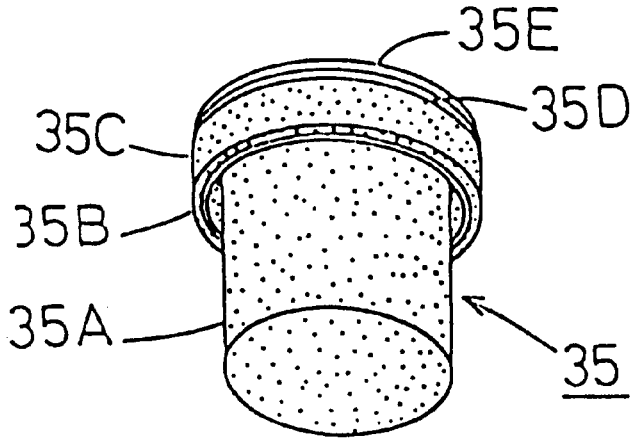
FIG. 11 and FIG. 12 relate to the fifth embodiment of the present invention.
Figure 12:
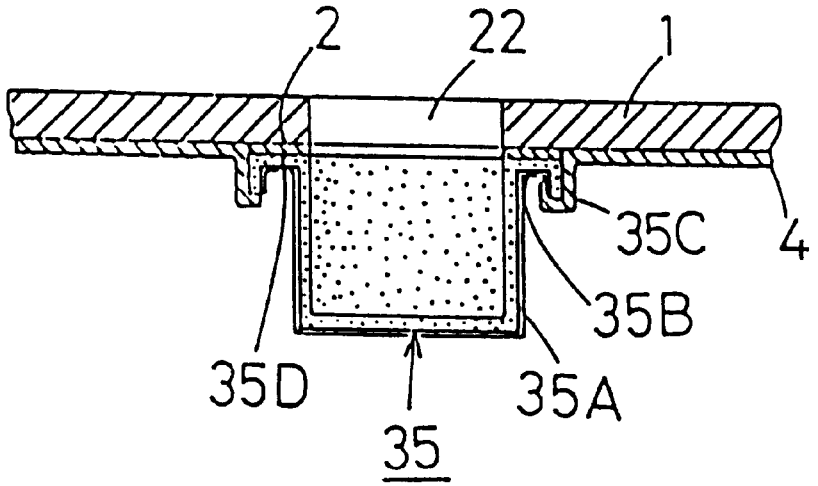

FIG. 11 and FIG. 12 relate to the fifth embodiment of the present invention. In this embodiment, a masking member (35) comprises a body (35A) having a vessel form consisting of a circular bottom, an inner perpendicular wall which extends upwards from the circumference of said bottom, a flange (35B) which is extended from the upper edge of said wall, and an outer perpendicular wall (35C) which extends downwards from the perimeter of said flange (35B), and an adhesive layer (35D) formed on the surface of said flange (35B). Said adhesive layer (35D) is covered with a release sheet (35E).

When said masking member (35) is used, said release sheet (35E) is removed from said adhesive layer (35D) and said masking member (35) is then attached to an even part (2) of the surface of an article (1) by said adhesive layer (35D) thereof, and said part (2) has a hole (22). After said masking member (35) is attached to said part (2), a coating is effected on the surface of said article (1) to form a coating layer (4) as shown in FIG. 12. Said masking member (35) can be removed from said part (2) of said article (1) by a worker's hand without obstruction of said coating layer (4). Said masking member (35) is easily manufactured by vacuum forming and can be reused the same as the fourth embodiment. Further, said part (2) of said article (1) may be an even part without hole (22).

[Masking member Type C]

Masking member Type C is used to protect hole(s) of an article. Said masking member C is manufactured by vacuum forming of a sheet consisting of methylpentene copolymer.

Figure 13:
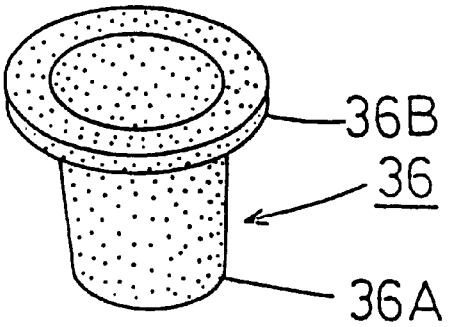
FIG. 13 and FIG. 14 relate to the sixth embodiment of the present invention.
Figure 14:
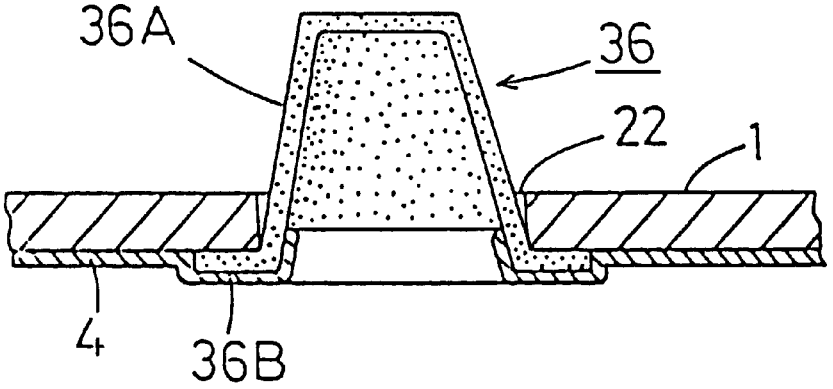

FIG. 13 and FIG. 14 relate to the sixth embodiment of the present invention. In this embodiment, a masking member (36) consists of an inserting part (36A) having a vessel form consisting of a circular bottom and a perpendicular wall which extends upwards from the circumference of said bottom, and a flange (36B) which is extended from the upper edge of said wall.

When said masking member (36) is used, said masking member (36) protects the inside of a hole (22) of an article (1) by inserting said inserting part (36A) into said hole (22) as shown in FIG. 14 and said flange (36B) of said masking member (36) covers the surroundings of said hole (22). After which, a coating is effected on the surface of said article (1) to form a coating layer (4) and the inside and surroundings of said hole (22) are not subjected to said coating. After said coating, said masking member (36) may be removed from said hole (22) by hand. As said masking member (36) has a good heat resistance and does not deform during curing process of said coating layer (4), said masking member can be reused.

Further in a case where the primer coating treatment using an acrylic synthetic resin including a quaternary ammonium salt is effected on the surface of said masking member (36), the film of the paint may be strongly bonded with the surface of said masking member (36) and after the heating treatment, said film of the paint does not peel from the surface of said masking member (36) so that pieces of the film of the paint peeling from the surface of said masking member (36) are not formed to avoid contamination of the circumference by said pieces of the film of the paint. Accordingly, said masking member (36) may be preferably used repeatedly without peeling the film of the paint.

Figure 15:
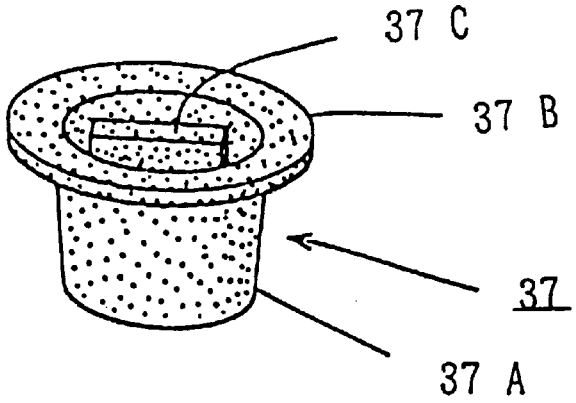
FIG. 15 is the perspective view of the seventh embodiment of the present invention.

FIG. 15 relates to the seventh embodiment of the present invention. In this embodiment, a masking member (37) comprises an inserting part (37A) having a vessel form consisting of a circular bottom from which a grip (37C) is risen, and perpendicular wall which extends upwards from the circumference of said bottom, and a flange (37B) which is extended from the upper edge of said wall. The masking member (37) of this embodiment is used the same as the sixth embodiment and is easily handled by holding said grip (37C) when said masking member (37) is inserted into the hole of the article or removed from the hole. Said masking member (37) is easily manufactured by vacuum forming and can be reused the same as the sixth embodiment.

Figure 16:
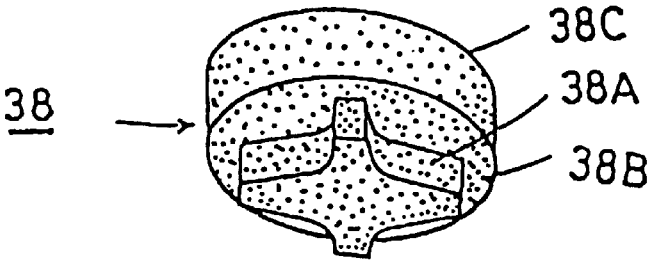
FIG. 16 is the perspective view of the eighth embodiment of the present invention.

FIG. 16 relates to the eighth embodiment of the present invention. In this embodiment, a masking member (38) consists of an inserting part (38A) having vessel form consisting of a cross-shaped bottom and a perpendicular wall which extends upwards from the perimeter of said bottom, a flange (38B) which is extended from the upper edge of said wall, and a perpendicular wall (38C) which extends upwards from the circumference of said flange (38B).

Said masking member (38) is inserted into a hole (22) of the article (1) by said inserting part (38A) the same as the sixth embodiment and further said masking member (38) is supported in the inner wall of said hole by only partially contacts at the tips of said inserting part (38A) so that attaching and removing of said masking member (38) to(from) the hole may be very easy. Further, the material of said masking member (38) may be less than the masking member having cylindrical form.

Figure 17:
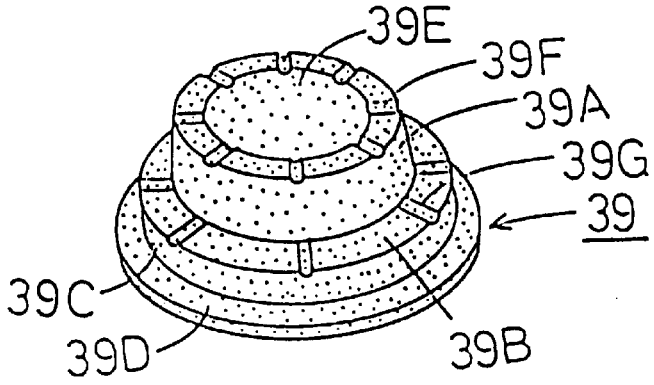
FIG. 17 and FIG. 18 relate to the ninth embodiment of the present invention.
Figure 18:
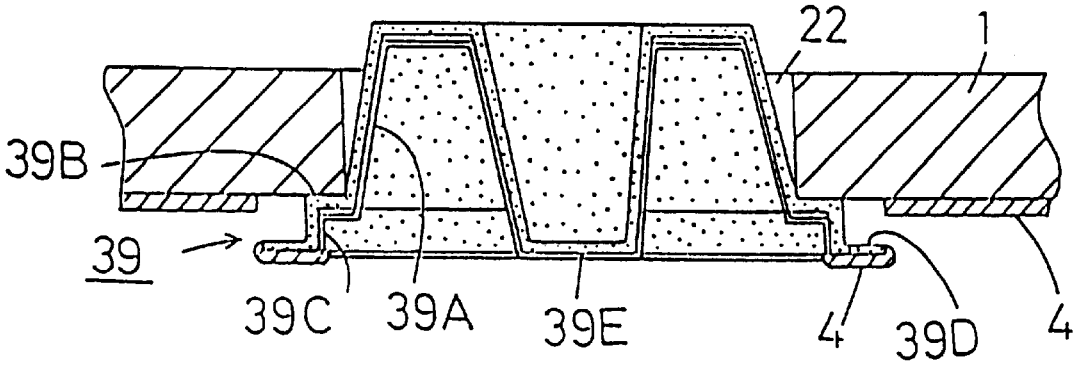

FIG. 17 and FIG. 18 relate to the ninth embodiment of the present invention. In this embodiment, a masking member (39) consists of an inserting part (39A) having vessel from consisting of circular bottom from which a grip (39E) is risen and an inner perpendicular wall which extends upwards from the circumference of said bottom, a lower flange (39B) which is extended from the upper part of said wall, an outer perpendicular wall (39C) which extends upwards from the circumference of said lower flange (39B), and an upper flange (39D) which is extended from the upper part of said wall (39C), and plural radiated grooves (39F) and (39G) are respectively formed in said lower flange (39B) and said upper flange (39D).

As shown in FIG. 18 said masking member (39) is inserted into a hole (22) of an article (1) the same as the sixth embodiment and since a coating layer (4) may be cut by said upper flange (39D) of said masking member (39), the removing of said masking member (39) from said hole (22) may be very smooth without obstruction of said coating layer (4) and further said grooves (39F) and (39G) respectively reinforce said lower and upper flanges (39B) and (39D). Said masking member (37) is easily manufactured by vacuum forming and can be reused the same as the sixth embodiment.

[Masking member Type-D]

Masking member Type D is used to protect the extending part of the article and manufactured by vacuum forming of a sheet consisting of polycarbonate in which 50% by weight of calcium carbonate is mixed.

Figure 19:
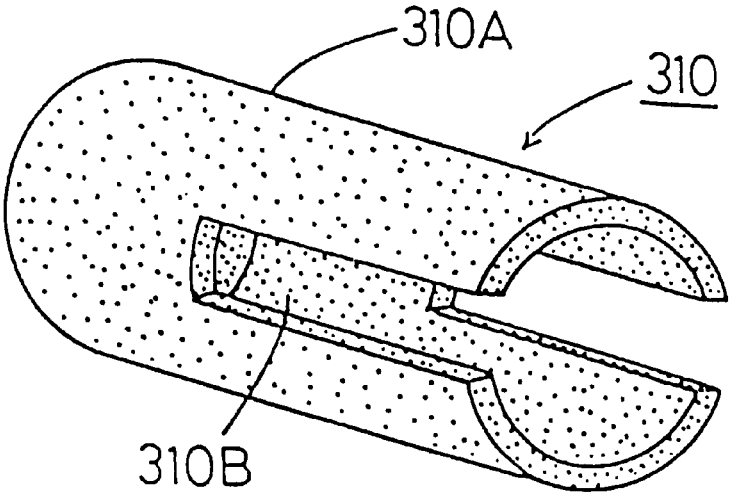
FIG. 19 and FIG. 20 relate to the tenth embodiment of the present invention.
Figure 20:
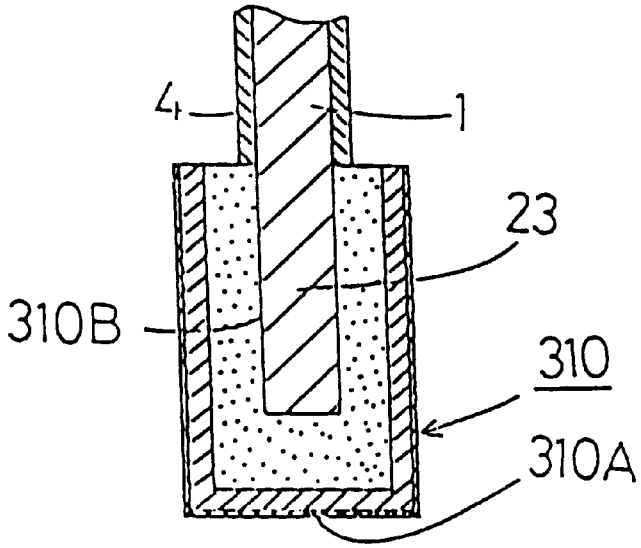

FIG. 19 and FIG. 20 relate to the tenth embodiment of the present invention. In this embodiment, a masking member (310) consists of a body (310A) having a cylindrical vessel form, which has a slit (310B) formedd from the opening end of said body (310A). An extending part (23) of the article (1) to be protected is inserted into said slit (310B) of said masking member (310) and the coating layer (4) is not formed on said extending part (23) since said extending part (23) is protected by said masking member (310) as shfown in FIG. 20. After coating, said masking member (310) is removed from said extending part (23) by a worker's hand. Said masking member (310) is easily manufactured by vacuum forming and can be reused.

FIG. 21 to FIG. 26 relate to an applied embodiment in which the masking members Type A, B, C and D are piled to the under side (12) of the car body (11) for corrosion, sound and vibration-proof.

Figure 21:
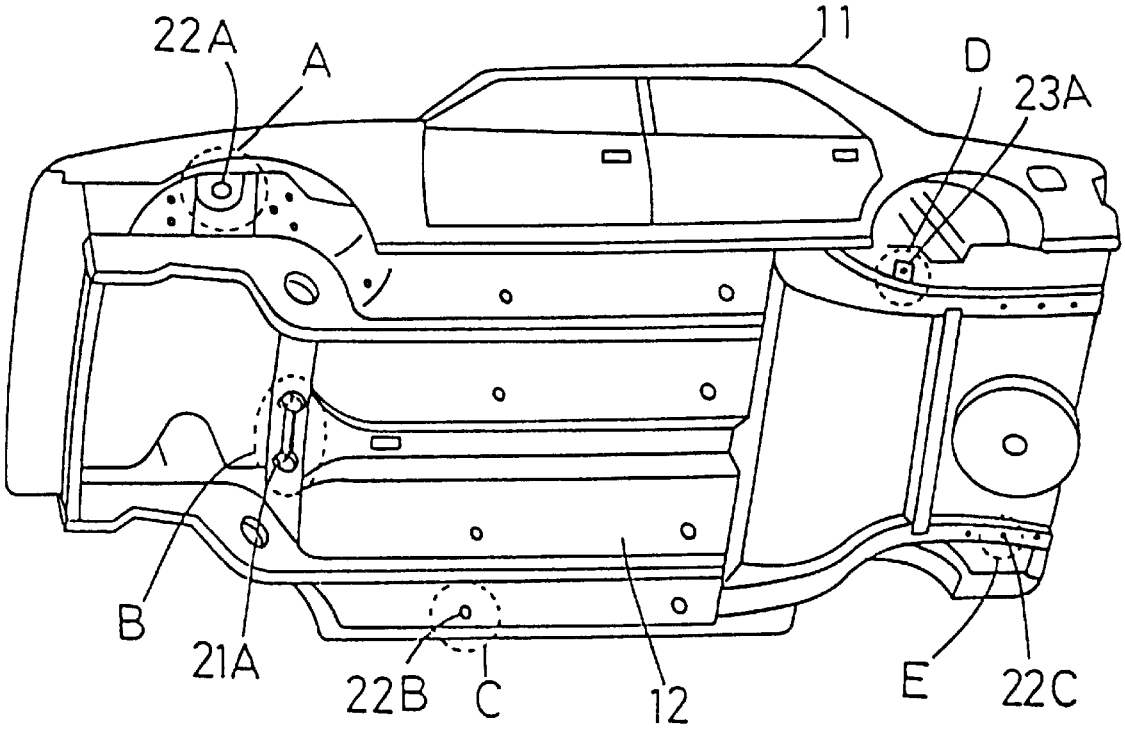
FIG. 21 to FIG. 26 relate to the practical examples of the present invention.
Figure 22:
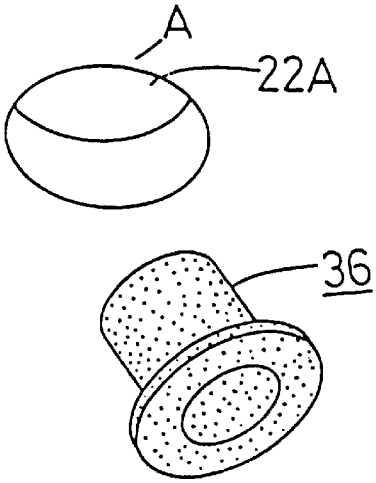

As shown in FIG. 21, the masking members of the present invention are attached to parts A, B, C, D and E of the under side (12) of a car body (11). Namely, as shown in FIG. 22, the masking member Type C, such as said masking member (36) of the sixth embodiment may be attached to a hole (22A) of part A into which a spring axis of a forward wheel is inserted and the circumference of the hole (22A) is used as a bed for the spring.

Figure 23:
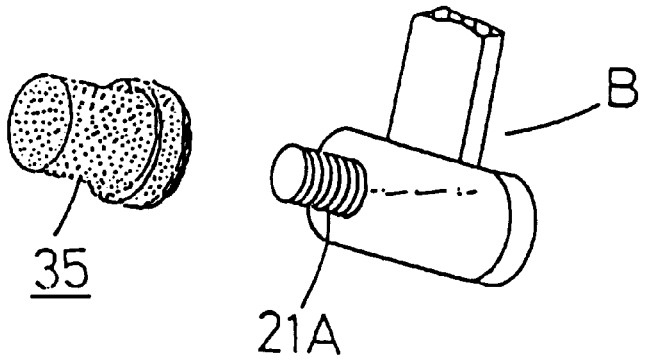

As shown in FIG. 23, the masking member Type B, such as said Type B masking member (35) of the fifth embodiment is attached to a bolt (21A) of part B.

Figure 24:
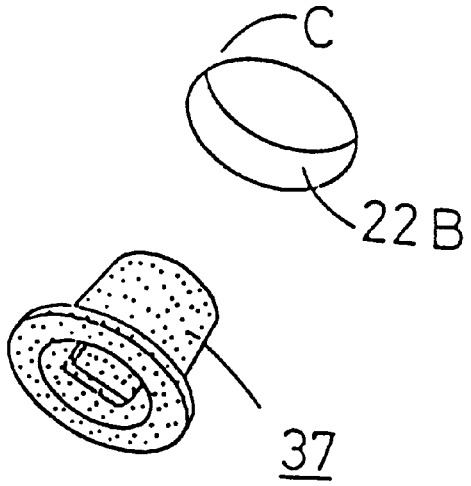
Figure 25:
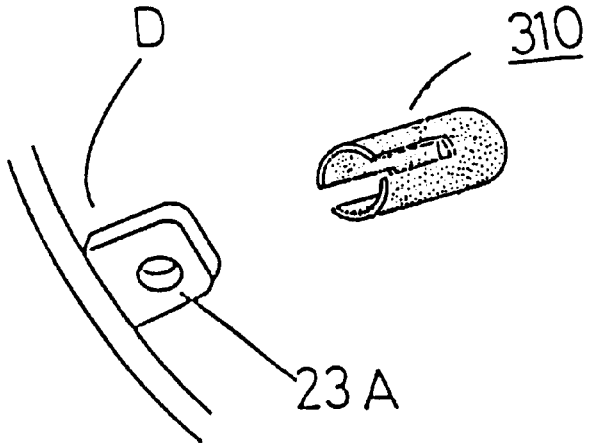
Figure 26:
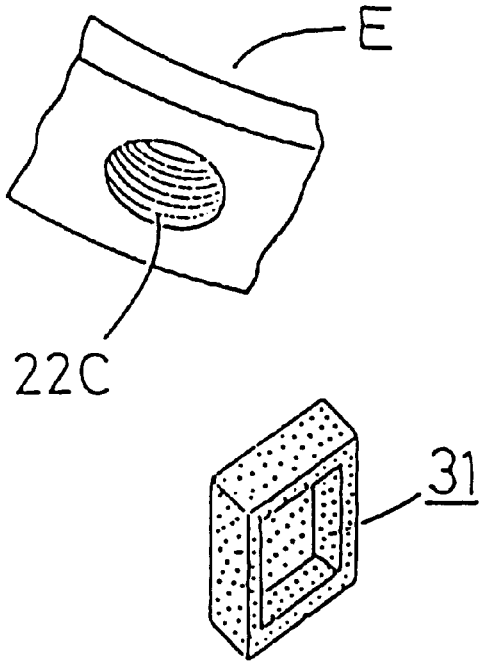

As shown in FIG. 24, the Type C masking member (37) of the seventh embodiment is inserted into a drainage hole (22B), as shown in FIG. 25, the masking member (310) of the tenth embodiment is attached to a bracket (23A) of part D, and as shown in FIG. 26, the Type A masking member (31) of the first embodiment is attached to a screw hole (22C). Thus, said hole (22A), said bolt (21A), said drainage hole (22B), said bracket (23A) and said screw hole (22C) are protected by said masking members of the present invention from coating.

Figure 27:
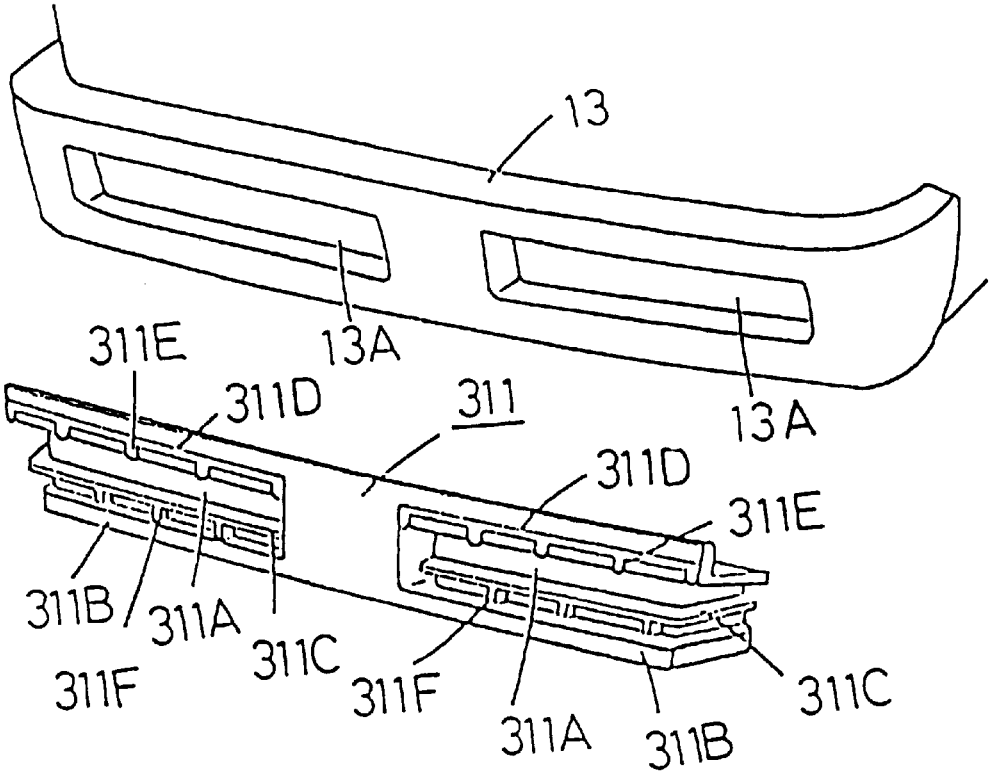
FIG. 27 and FIG. 28 relate to the eleventh embodiment of the present invention.
Figure 28:
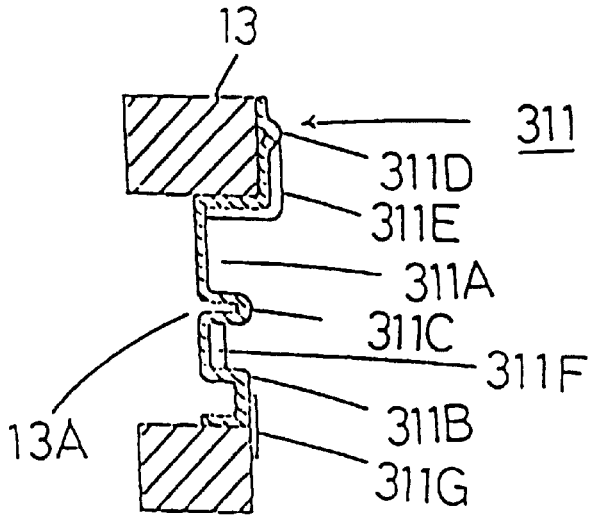

FIG. 27 and FIG. 28 relate to the eleventh embodiment of the present invention. A masking member (311) is used to protect a bumper (13), and a fitting part (311A) which is fitted in an air-intake (13A) of said bumper (13), a flange (311B) having a C-shaped cross section on the lower edge of said fitting part (311A), and horizontal ribs (311C),(311D) and vertical ribs (311E),(311F) for reinforcement are formed in said masking member (311).

When the masking member (311) is attached to the bumper (13) by fitting the fitting part (311A) in the air-intake (13A) of said bumper (13), as said fitting part (311A) of said masking member (311) is reinforced by the flange (311B) and prevented from obstruction, fitting is easily achieved. In addition, since the surface of said flange (311B) is substantially on the same plane as the lower edge of said air-intake (13A) of said bumper (13) in this state, as shown in FIG. 28, it can be easily fixed thereover by the adhesive tape (311G). Material for the masking member (311) of the above described embodiment is engineering plastic in which polyamide is mixed with PPE.

Figure 29:
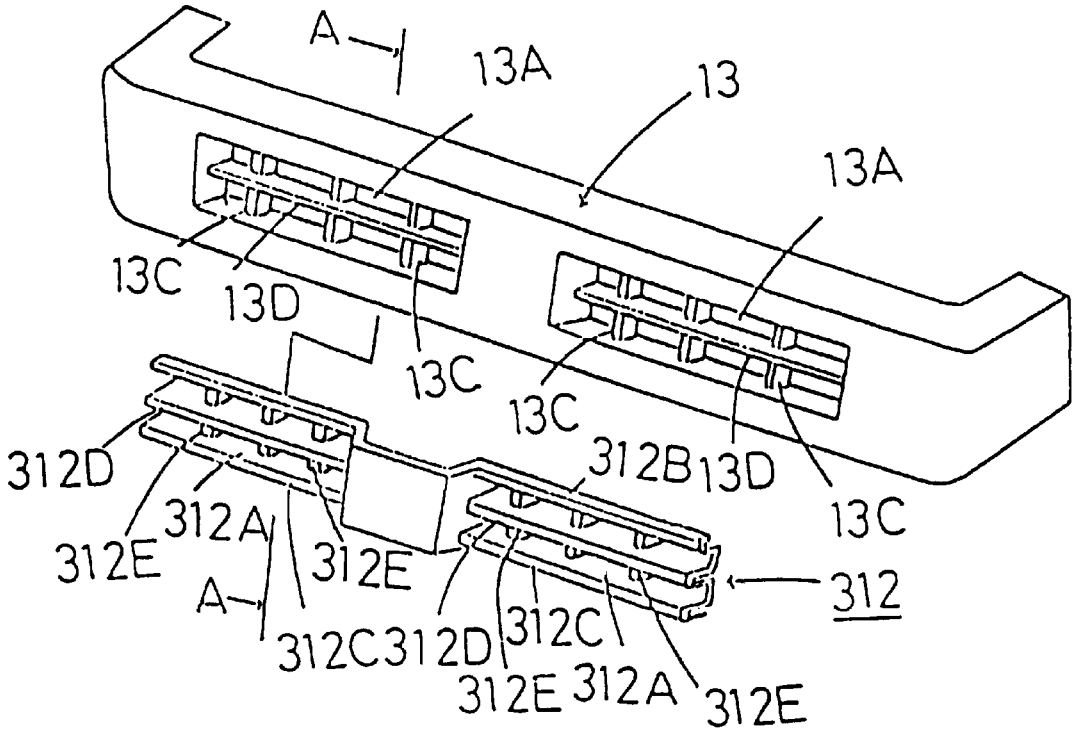
FIG. 29 to FIG. 31 relate to the twelfth embodiment of the present invention.
Figure 30:
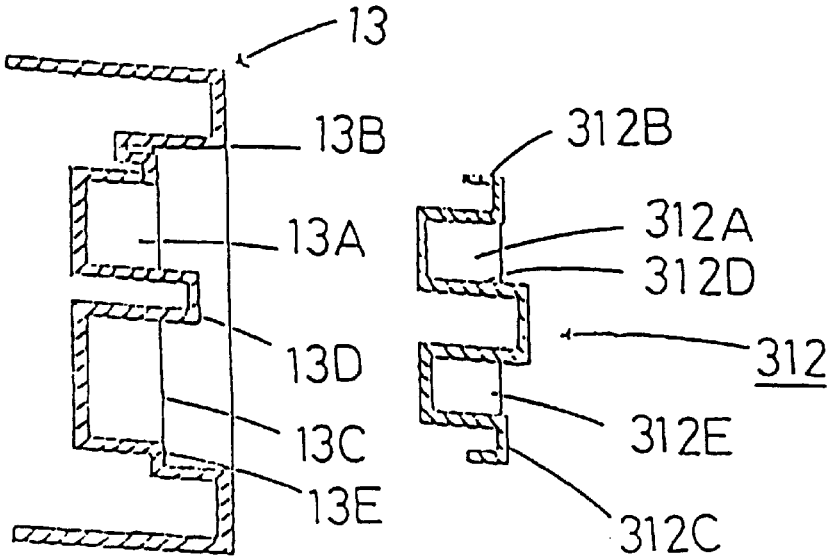
Figure 31:
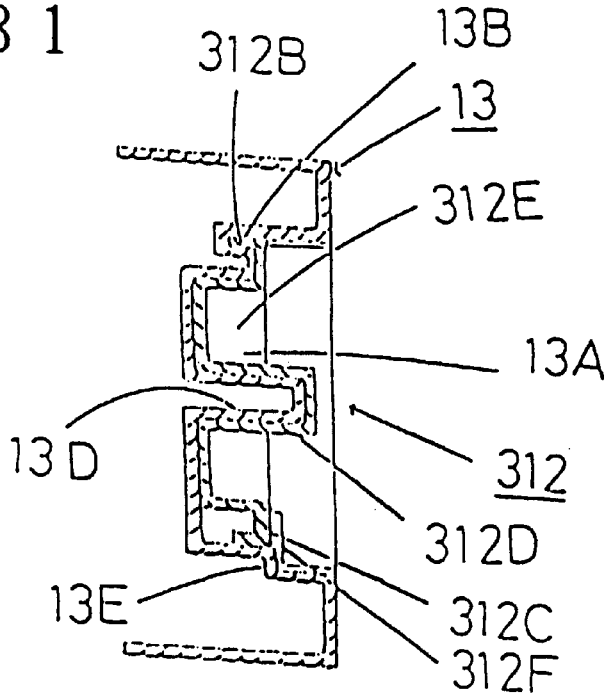

FIG. 29 to FIG. 31 relate to the twelfth embodiment of the present invention. A masking member (312) of this embodiment is also used to protect a bumper (13). A pair of air-intakes (13A),(13A) is formed on said bumper (13), and vertical ribs (13C),(13C) and horizontal ribs (13D),(13D) are formed in the inside of said air-intakes (13A),(13A), and further grooves (13B),(13B) are formed on the upper edge of the air-intakes (13A),(13A) as shown in FIG. 30. Flight parts (13E),(13E) are also formed on the lower edge of the air-intakes (13A),(13A).

Said masking member (312) is to protect the air-intakes (13A),(13A) of the bumper (13) from coating, and the masking member (312) has a pair of fitting parts (312A), (312A) which is fitted in the air-intakes (13A),(13A) of said bumper (13). On the upper edge of said fitting parts (312A), (312A), a fitting flanges (312B),(312B) are formed. On the lower edge of said fitting parts (312A),(312A) C-shaped bends (312C),(312C) are formed. Also horizontal fitting ribs (312D),(312D) and vertical fitting ribs (312C),(312C) are formed on said fitting parts (312A),(312A) of said masking member (312).

When the masking member (312) is attached to the bumper (13) by fitting the fitting parts (312A),(312A) in the air-intakes (13A),(13A) and fitting a horizontal ribs (13D), (13D) and vertical ribs (13C),(13C) of the air-intakes (13A), (13A) respectively in horizontal fitting ribs (312D),(312D) and vertical fitting ribs (312E),(312E). As shown in FIG. 31, fitting flange (312B),(312B) on the upper edge of the fitting parts (312A),(312B) of said masking member (312) is fitted in grooves (13B),(13B) without using adhesive tape.

Since the lower edge of the fitting parts (312A),(312A) is reinforced by the bends (312C),(312C) and is protected from deformation, fitting is easily achieved. Since the surface of said bends (312C),(312C) is substantially on the same plane as the flight parts (13E),(13E) of said air-intakes (13A), (13A) of the bumper (13) in this state, as shown in FIG. 31, it can be easily fixed thereover by the adhesive tape (312F). Material for the masking member (312) of the embodiment is the engineering plastic of the eleventh embodiment.

Figure 32:
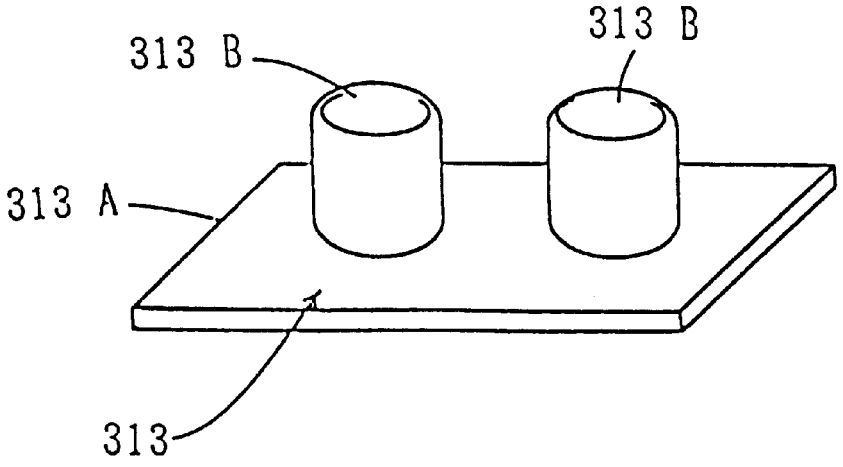
FIG. 32 and FIG. 33 relate to the thirteenth embodiment of the present invention.
Figure 33:
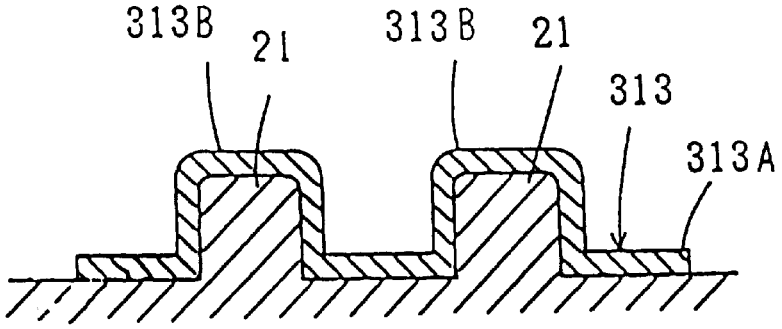

FIG. 32 and FIG. 33 relate to the thirteenth embodiment of the present invention. In this embodiment, a masking member (313) is used to protect plural protrusions (21),(21) of an article from a surface treatment. Said masking member (313) comprises a body (313A) and fitting parts (313B), (313B) projected from said body (313A).

Said masking member (313) is attached to said plural protrusions (21),(21) of an article by said fitting parts (313B),(313B) to protect said parts (21),(21) of said article from said surface treatment as shown in FIG. 33.

Said masking member (313) is easily manufactured by vacuum forming of two layers sheet and can be reused the same as the fourth embodiment.

Figure 34:
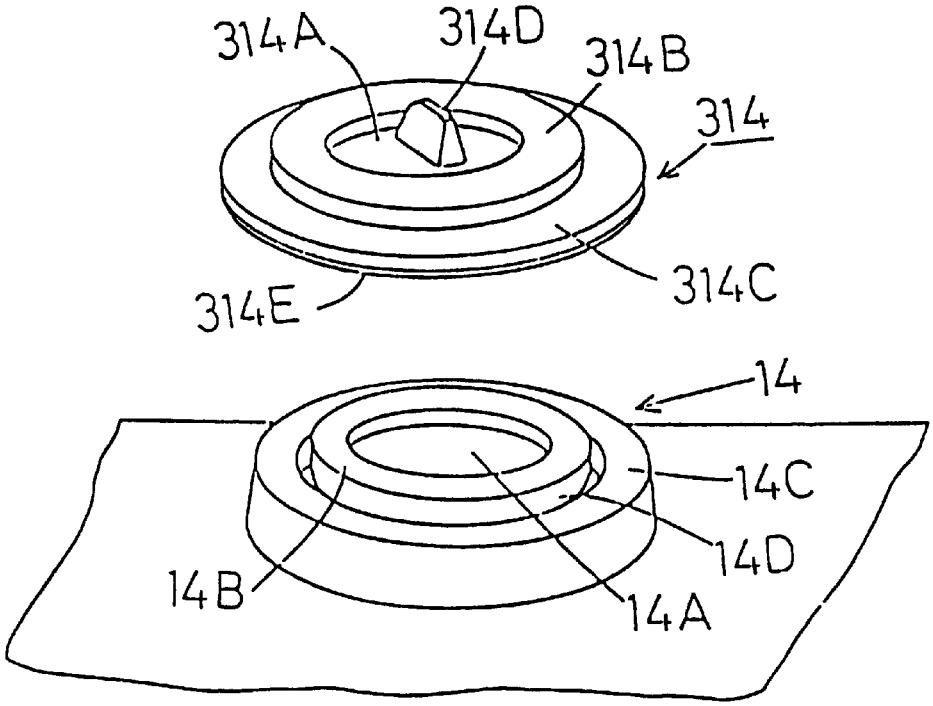
FIG. 34 to FIG. 36 relate to the fourteenth embodiment of the present invention.
Figure 35:
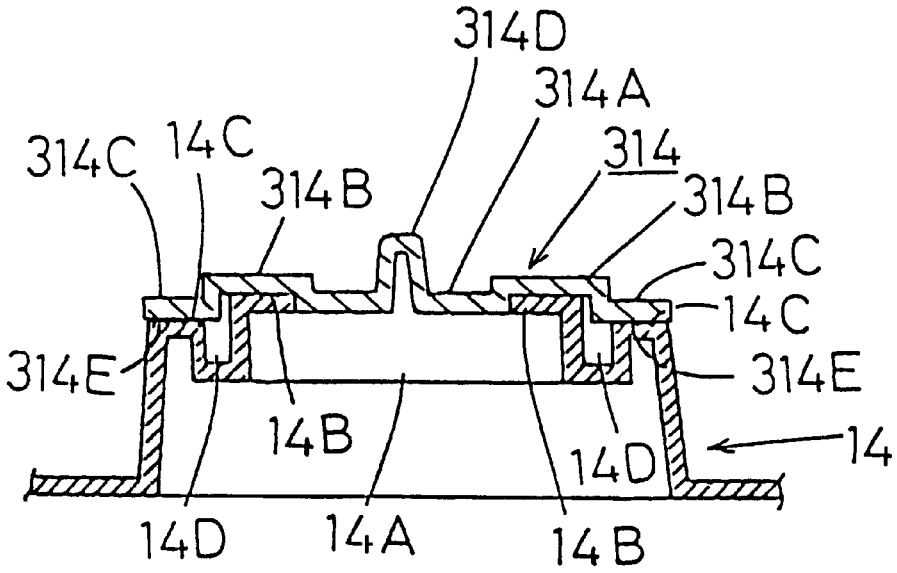
Figure 36:
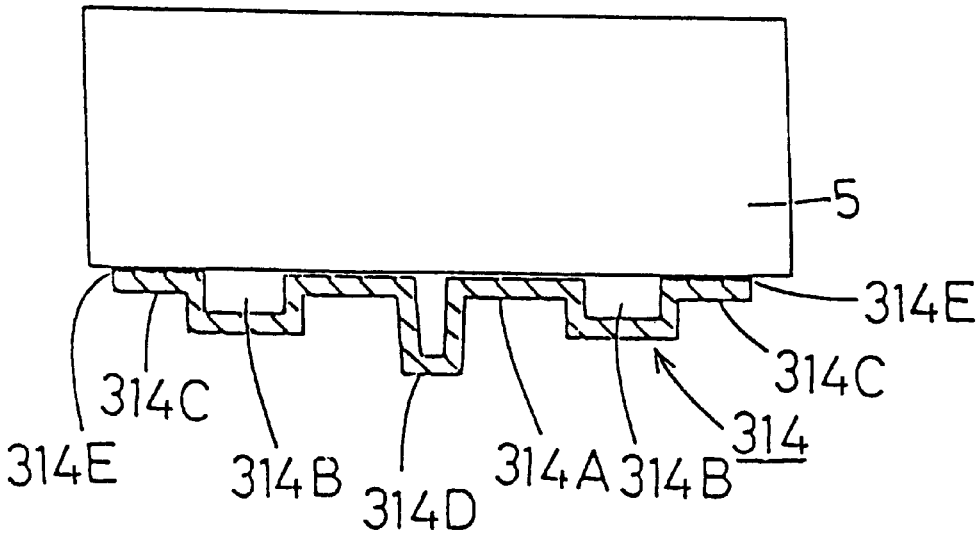
Figure 37:
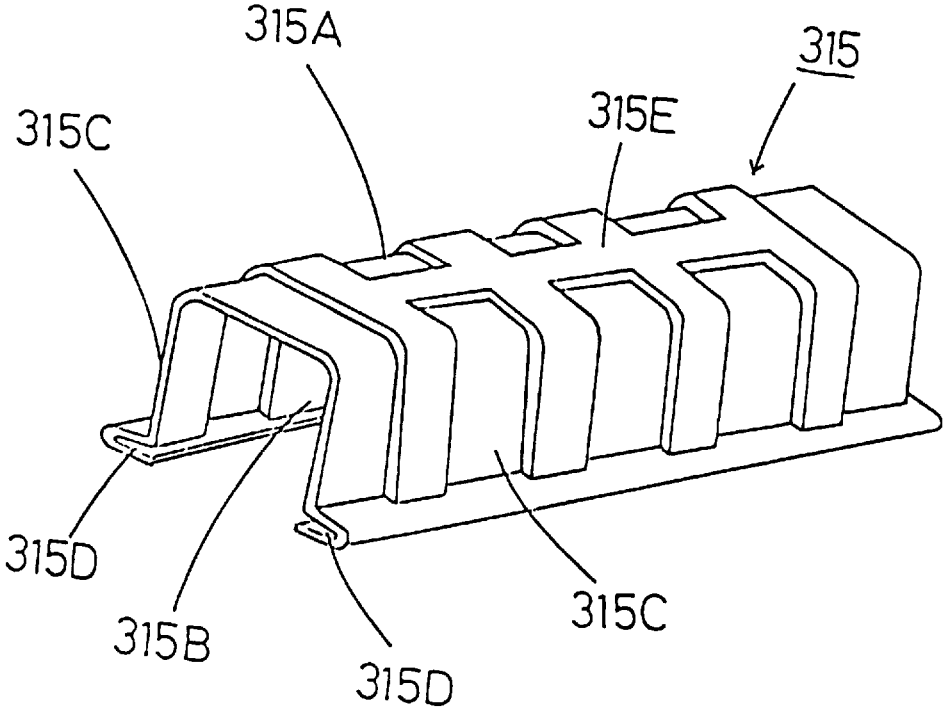
FIG. 37 to FIG. 40 relate to the fifteenth embodiment of the present invention.

FIG. 34 to FIG. 36 relate to the fourteen embodiment of the present invention. In the figures, an inlet (14) of the fuel tank of the car consists of a hole part (14A), an inner flange part (14B) surrounding said hole part (14A), and an outer flange part (14C) formed at the outside of said inner flange part (14B) intermediating a packing groove (14D) and said inner flange part (14B) is slightly higher than said outer flange part (14C).

A masking member (314) consists of a central disk part (314A), an outer ring part (314C) surrounding said central disk part (314A) intermediating a guide groove (314B), a grip (314D) projecting from said central disk part (314A) and an adhesive layer (314E) formed on the backside of said outer ring part (314C) and said masking member (314) is manufactured by the vacuum forming of a polymer alloy film consisting of PPE and polyamide containing 30% by weight of calcium carbonate.

When said masking member (314) is attached to said inlet (14), the position of said masking member (314) is adjusted by inserting said inner flange part (14B) of said inlet (14) into said guide groove (314B) of said masking member (314) and then said adhesive layer (314E) of said outer ring part (314C) is pressed to the top of said outer flange part (14C) as shown in FIG. 35 and the paint is prevented from going into the fuel tank through said inlet (14) by said masking member (314).

As no projecting part rising from said outer ring part (314C) in the backside of said masking member (314), the adhesive can be applied on the backside of said outer ring part (314C) to form said adhesive layer by a roll coater (5) as shown in FIG. 36.

FIG. 37 to FIG. 40 relate to the fifteenth embodiment of the present invention. In the figures, a masking member (315) consists of a body (315A) inside of which an inserting part (315B) for a pillar body (15A) of a pillar member (15) is formed and a pair of flange inserting parts (315D),(315D) formed along the lower end of side walls (315C),(315C) of said body (315A) and in which a pair of flanges (15D),(15D) are respectively inserted and reinforcing ribs (315E) are formed on the circumference of said body. Said masking member (315) is manufactured by the same method using the same material as the fourteenth embodiment.

Said masking member (315) is attached to said pillar member (15) and said pillar member (15) is constituted by an outer panel (15A) and an inner panel (15B) and consists of a pillar body (15A) and flanges (15D),(15D) formed along the lower ends of a pair of side walls (15C),(15C).

Figure 38:
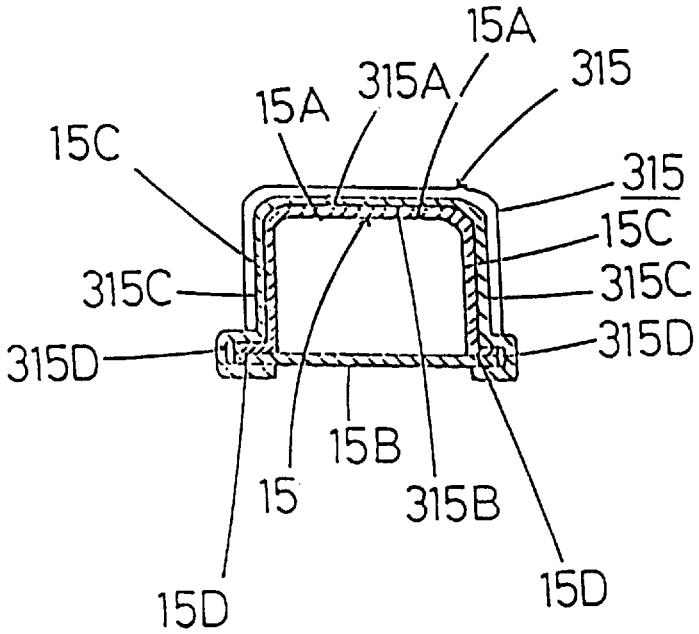

Said masking member (315) is attached to said pillar member (15) by inserting said pillar body (15A) into said inserting part (315B) of said masking member (315) and inserting flanges (15D),(15D) of said pillar body (15A) into said flange inserting parts (315D),(315D) of said masking member (315) respectively as shown in FIG. 38. After said masking member (315) is attached to said pillar member (15) as above described, a surface treatment such as a coating, plating or the like is effected and after said surface treatment, said masking member (315) is removed from said pillar member (15).

Figure 39:
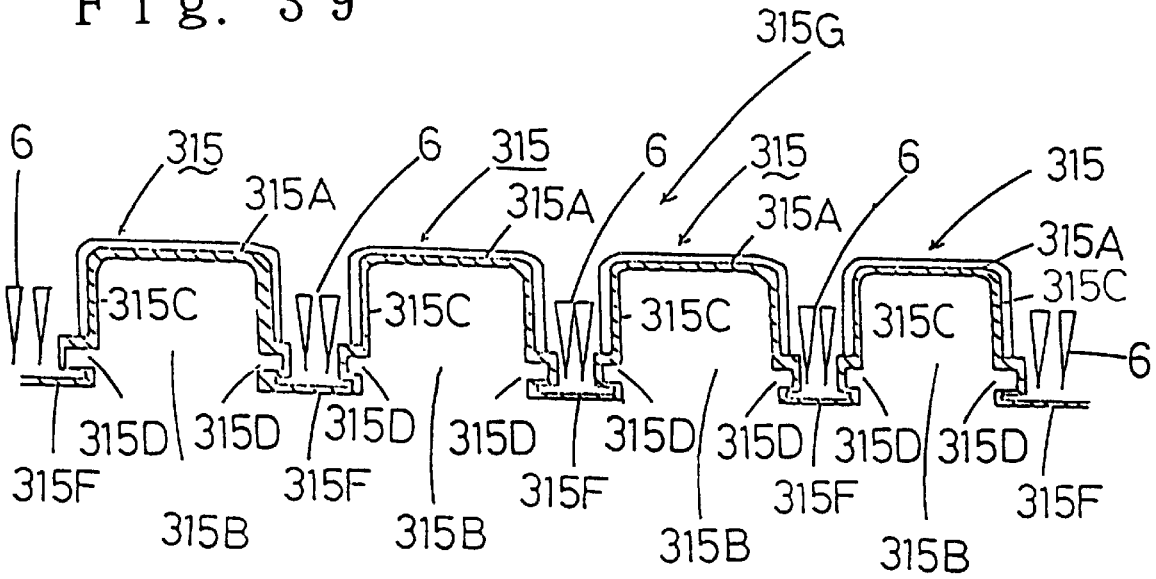
Figure 40:
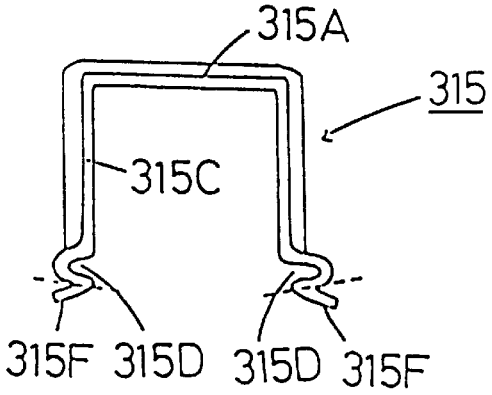

To manufacture said masking member (315), first a masking member assemblage (315G) consisting of a plural number of said masking members (315) connected respectively through connecting parts (315F) is molded by the vacuum forming, press molding, and the like using a thermoplastic resin sheet as shown in FIG. 39, and then said masking member assemblage (315G) is cut by a cutter (6) at said connecting parts (315F) as shown in FIG. 40 and the resulting cut parts are further cut along dotted lines shown in FIG. 40 by a cutter, a shears or the like to obtain said masking member (315).

Figure 41:
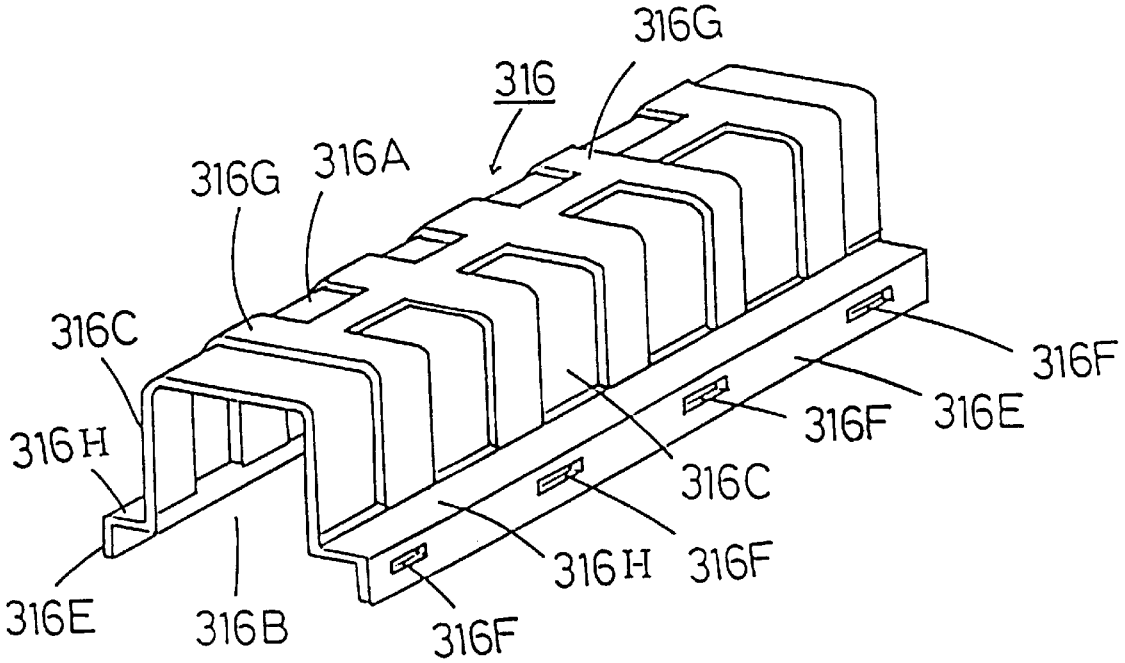
FIG. 41 and FIG. 42 relate to the sixteenth embodiment of the present invention.
Figure 42:
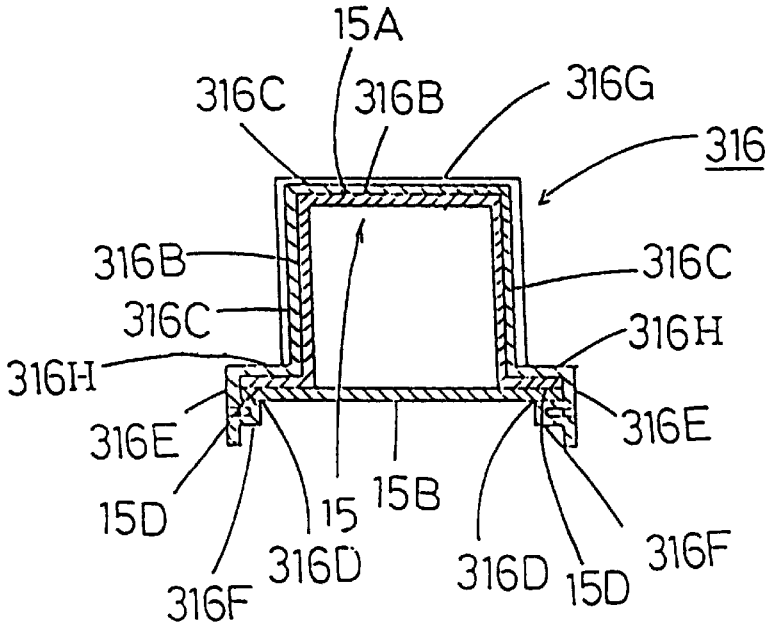
Figure 43:
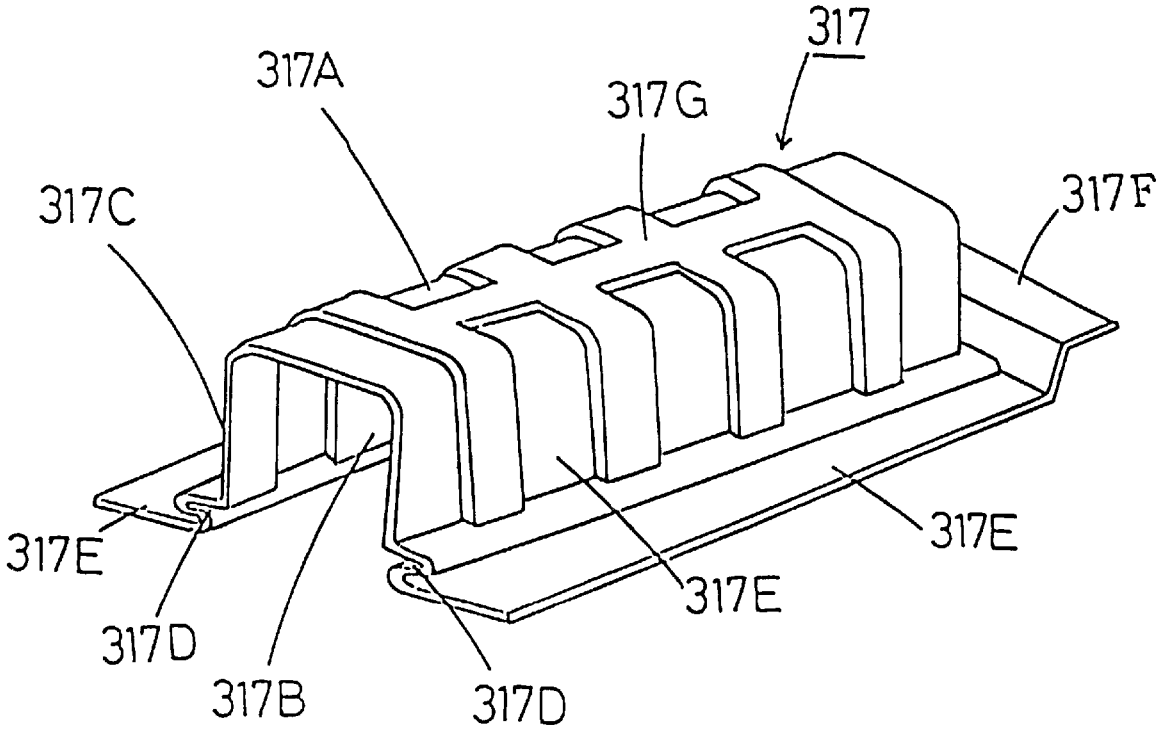
FIG. 43 to FIG. 46 relate to the seventeenth embodiment of the present invention.

FIG. 41 and FIG. 42 relate to the sixteenth embodiment of the present invention. A masking member (316) in this embodiment consists of a body (316A) inside of which an inserting part (316B) for a pillar body (15A) of a pillar member (15) is formed, and projections (316F) formed on the insides of a pair of lower side walls (316E),(316E) which are formed respectively along the lower ends of a pair of side walls (316C),(316C) of said pillar body (316A) intermediating flight parts (316H)(316H), and flange inserting parts (316D),(316D) are formed upon said projections (316F) and further reinforcing ribs (316G) are formed on the circumference of said body (316A).

Said masking member (316) is made of a polymer alloy consisting of PPE and polystyrene containing 30% by weight of calcium carbonate and is manufactured by vacuum forming using said polymer alloy sheet.

Said masking member (316) is attached to a pillar member (15) by inserting a pillar body (15A) of said pillar member (15) into said inserting part (316B) of said masking member (316) and inserting flanges (15D),(15D) of said pillar member (15) into said flange inserting parts (316D), (316D) of said masking member (316) as shown in FIG. 42.

Figure 44:
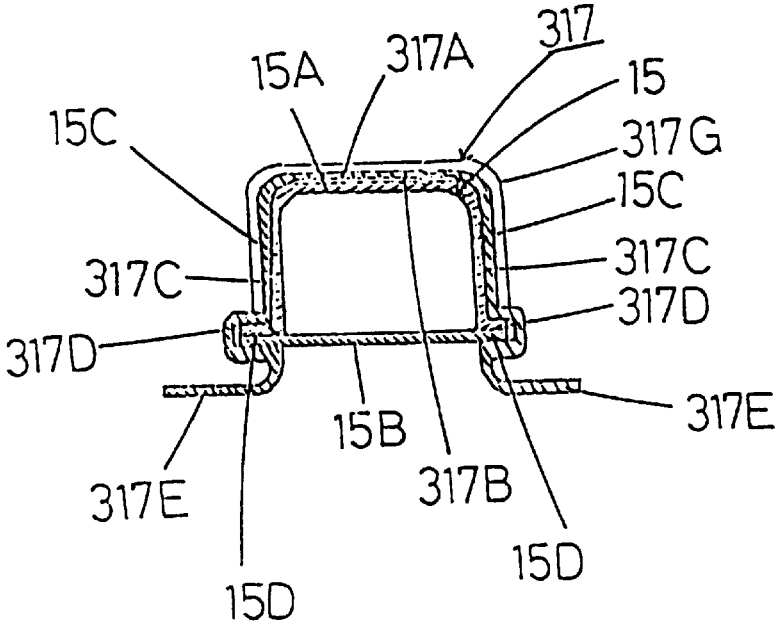

FIG. 43 to FIG. 46 relate to the seventeenth embodiment of the present invention. A masking member (317) shown in FIG. 43 consists of a body (317A) inside of which an inserting part (317B) of a pillar body (15A) of a pillar member (15) is formed, flange inserting parts (317D), (317D) into which flanges (15D),(15D) of said pillar member formed along a pair of side walls (317C),(317C) of said body (317A) is inserted, a pair of back sheets (317E),(317E) extending from said flange inserting parts (317D),(317D), and an upper sheet (317F) extending from the upper end of said body (317A), and reinforcing ribs (317G) are formed on the circumference of said body (317A) and said masking member (317) is manufactured by the same method using the same material as the sixteenth embodiment. Said masking member (317) is provisionally attached to a pillar body (15A) of a pillar member (15) shown in FIG. 44 by inserting said pillar body (15A) into said inserting part (317B) of said masking member (317) as shown in FIG. 44 and inserting said flanges (15D),(15D) of said pillar member (15) into said flange inserting parts (317D),(317D), respectively as described in the fourteenth embodiment.

Figure 45:
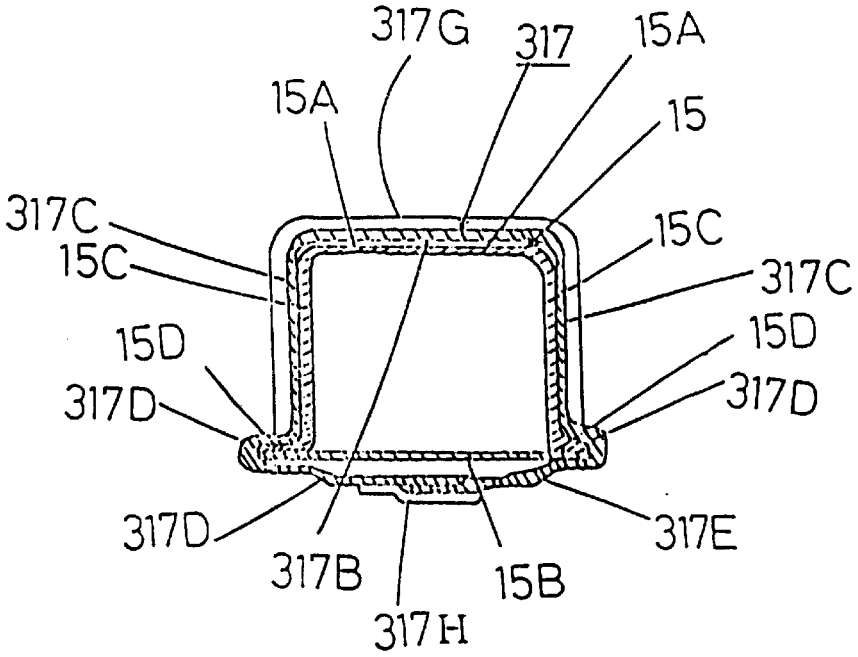

After said masking member (317) is provisionally attached to said pillar member (15), said back sheets (317E), (317E) are respectively turned over to be attached to the back side of said pillar member (15) and said back sheets (317E),(317E) are mutually fixed by such as an adhesive tape (317H), a tacker, or the like as show in FIG. 45.

Figure 46:
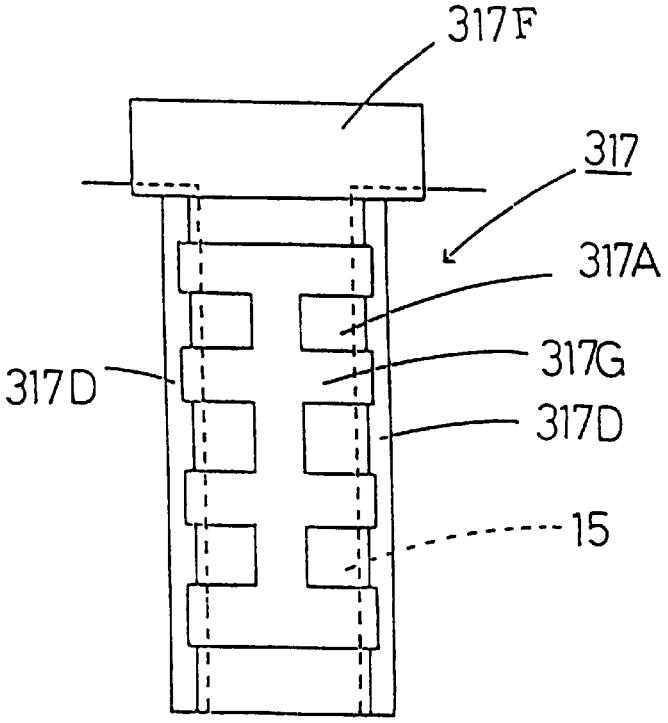

As above described, after said masking member (317) is attached to said pillar member (15) as shown in FIG. 46, a surface treatment such as a coating, a plating or the like is effected. Since the back side of said pillar member (15) is covered with said back sheets (317E), (317E) of said masking member (317), said surface treatment is not effected on the backside of said pillar member (15). After said surface treatment, said masking member (317) is removed from said pillar member (15) by peeling off said adhesive tape (317H) from back sheets (317E),(317E) of said masking member (317).

We claim:

1. A method of masking a structure to protect a selected surface of said structure during a surface treatment operation which comprises:

applying to said structure a masking member made of one or more kinds of engineering plastic selected from the group consisting of methylpentene copolymer (TPX), polysulphone (PSF), polyethersulphone (PES), polyphenylene sulfide (PPS), polyphenylene ether (PPE), polyamideimide (PAI), polyetherimide (PEI), and polyether-etherketone (PEEK);

subjecting said structure, including said applied masking member, to a paint coating operation;

removing the masking member from said surface treated structure; and employing said masking member in another surface treatment operation.

2. A method of masking a structure to protect a selected surface of said structure during a surface treatment operation which comprises:

providing one or more kinds of engineering plastic selected from the group consisting of methylpentene copolymer (TPX), polysulphone (PSF), polyethersulphone (PES), polyphenylene sulfide (PPS), polyphenylene ether (PPE), polyamideimide (PAI), polyetherimide (PEI), and polyether-etherketone (PEEK) (PI);

mixing thermoplastic resin in said engineering plastic to form a polymer alloy;

applying to said structure a masking member made of said polymer alloy;

subjecting said structure, including said applied masking member, to a paint coating operation;

removing the masking member from said surface treated structure; and employing said masking member in another surface treatment operation.

3. A masking member made of one or more kinds of engineering plastic selected from the group consisting of methylpentene copolymer (TPX), polysulphone (PSF), polyethersulphone (PES), polyphenylene sulfide (PPS), polyphenylene ether (PPE), polyamideimide (PAI), polyetherimide (PEI), and polyether-etherketone (PEEK).

4. A masking member in accordance with claim 3 wherein thermoplastic resin is mixed in said engineering plastic to form a polymer alloy.

5. A masking member in accordance with claim 4 wherein said thermoplastic resin is selected from the group consisting of polyethylene, polypropylene, ethylene-propylene copolymer, ethylene-vinylacetate copolymer, polyvinyl chloride, polystyrene, polymethacrylate, polyvinylidene chloride, styrene-butadiene copolymer and polyamide.

6. A masking member in accordance with claim 4 wherein said polymer alloy consists of PPE and a thermoplastic resin selected from the group consisting of polyamide, and polystyrene.

7. A masking member in accordance with claim 4 containing inorganic filler in an amount in the range 10–200% by weight based on the weight of said engineering plastic.

8. A masking member in accordance with claim 4 wherein said masking member is coated with a primer to increase its affinity to paint and/or adhesive.

9. A masking member in accordance with claim 4 wherein said masking member is vacuum formed.

10. A masking member in accordance with claim 4 wherein said masking member is coated with a release agent to decrease its affinity to paint and/or adhesive.

11. A masking member in accordance with claim 3 wherein thermoplastic resin is laminated on said engineering plastic.

12. A masking member in accordance with claim 11 wherein said thermoplastic resin is selected from the group consisting of polyethylene, polypropylene, ethylene-propylene copolymer, ethylene-vinylacetate copolymer, polyvinyl chloride, polystyrene, polymethacrylate, polyvinylidene chloride, styrene-butadiene copolymer and polyamide.

13. A masking member in accordance with claim 3 containing inorganic filler in an amount in the range 10–200% by weight based on the weight of said engineering plastic.

14. A masking member in accordance with claim 3 wherein said masking member is coated with a primer to increase its affinity to paint and/or adhesive.

15. A masking member in accordance with claim 3 wherein said masking member is vacuum formed.

16. A masking member in accordance with claim 3 wherein said masking member is coated with a release agent to decrease its affinity to paint and/or adhesive.

17. A masking member made of one or more kinds of engineering plastic selected from the group consisting of methylpentene copolymer (TPX), polyethylene terephthalate (PET), polycarbonate (PC), cellulose acetate (CA), polysulphone (PSF), polyethersulphone (PES), polyphenylene sulfide (PPS), polyphenylene ether (PPE), polyamideimide (PAI), polyetherimide (PEI), polyether-etherketone (PEEK), polyimide (PI), nylon 6, nylon 66, polybutylene terephthalate (PBT), polyallylester (PAE), polyethylene naphthalate (PEN), polyallylate (PAR), aminobimaleimide and bimaleimidoazine;

wherein said masking member is surface treated by corona discharge to increase its affinity to paint and/or adhesive.

18. A masking member made of one or more kinds of engineering plastic selected from the group consisting of methylpentene copolymer (TPX), polyethylene terephthalate (PET), polycarbonate (PC), cellulose acetate (CA), polysulphone (PSF), polyethersulphone (PES), polyphenylene sulfide (PPS), polyphenylene ether (PPE), polyamideimide (PAI), polyetherimide (PEI), polyether-etherketone (PEEK), polyimide (PI), nylon 6, nylon 66, polybutylene terephthalate (PBT), polyallylester (PAE), polyethylene naphthalate (PEN), polyallylate (PAR), aminobimaleimide and bimaleimidoazine;

wherein thermoplastic resin is mixed in said engineering plastic to form a polymer alloy; and wherein said masking member is surface treated by corona discharge to increase its affinity to paint and/or adhesive.

* * * * *